US007097092B1

(12) United States Patent
Marrale

(10) Patent No.: US 7,097,092 B1
(45) Date of Patent: Aug. 29, 2006

(54) PACKAGE FOR FOOD PRODUCTS

(75) Inventor: Bruce A. Marrale, Wildwood, MO (US)

(73) Assignee: Ralcorp Holding, Inc., St. Louis, MO (US)

( * ) Notice: Subject to any disclaimer, the term of this patent is extended or adjusted under 35 U.S.C. 154(b) by 553 days.

(21) Appl. No.: 10/211,177

(22) Filed: Aug. 2, 2002

(51) Int. Cl.
*B65D 3/00* (2006.01)

(52) U.S. Cl. ..... 229/117.35; 229/117.3; 229/117.33; 229/231; 229/217; 383/64

(58) Field of Classification Search ..... 229/117.35, 229/117.17, 117.3, 117.31, 117.32, 117.33, 229/117.34, 231, 224, 217, 117; 383/64
See application file for complete search history.

(56) References Cited

U.S. PATENT DOCUMENTS 2,446,308 A * 8/1948 Smith ..... 229/117.34
2,898,027 A * 8/1959 Scholle ..... 229/117.33
3,062,427 A * 11/1962 Z'Graggen ..... 229/117.33
3,426,955 A * 2/1969 Olson ..... 229/229
3,463,357 A * 8/1969 McLean, Jr. et al. ... 229/117.35
3,547,660 A * 12/1970 Weisberg ..... 229/117.33 X
3,599,858 A * 8/1971 Samsing ..... 229/229
4,890,761 A * 1/1990 Gaves ..... 229/117.34
5,101,642 A * 4/1992 Alexandrov ..... 206/427 X
5,165,545 A * 11/1992 Focke et al. ..... 206/494
5,295,579 A * 3/1994 Focke et al. ..... 206/494
6,007,246 A * 12/1999 Kinigakis et al. ..... 383/204
6,386,438 B1 * 5/2002 Walsh et al. ..... 229/117.27

* cited by examiner

*Primary Examiner*—Tri M. Mai
(74) *Attorney, Agent, or Firm*—Harness, Dickey & Pierce, P.L.C.

(57) ABSTRACT

A package for a flowable dry food product includes an outer rectangular box with a removable portion for forming an opening in a portion of the top, and a bag inside the box, having a reclosable portion extending substantially the length of the opening, but less than the entire width of the package.

2 Claims, 6 Drawing Sheets

PACKAGE FOR FOOD PRODUCTS

FIELD OF THE INVENTION

This invention relates to packages for food products, and in particular to packages for cereal.

BACKGROUND OF THE INVENTION

Cereal is most often packaged in a bag inside a rectangular paperboard folded carton or box with reclosable flaps on the top to provide access to the contents. An internal liner or bag is provided to protect the contents. While expensive, the carton, which protects that product from being crushed, and the liner which preserves freshness, is convenient to store on a shelf, and provides substantial display surfaces for product information and advertising. However, these packages also suffer from a number of inconveniences. First, it can be difficult to initially open the internal liner or bag. Second once opened it is difficult to reclose the package. The internal liner or bag is simply "rolled up" and readily unrolls, and the flaps on the box top often come undone. Thus, the product can become stale, and there a risk of spillage if the package is knocked over or tilted. Third, it can be difficult to accurately pour the product from the container without spillage.

Recently, cereal has been packaged in recloseable bags. These bags are relatively inexpensive, and without the interference of a surrounding box reclosing the bag is easier. However, while these bags are usually easy to reseal, without the box these bags do not protect the product as well, are less convenient to store on a shelf, and do not provide a significant display surface for product information and advertising.

SUMMARY OF THE INVENTION

This invention provides an improved package for cereal and other dry flowable food products. Generally, the package of this invention comprises an outer generally rectangular prismatic box having a bottom panel, opposed front and back panels, and opposed left and right side panels extending between the front and back panels, and a top panel; a line of perforations for forming an opening in a portion of the top panel. There is an inner bag inside the box, the top of the bag having a reclosable opening in a portion thereof, generally corresponding to the size of the opening in the top panel of the box.

The package can be opened by removing a portion of the outer box defined by the line of perforations, to expose the inner bag. The inner bag has a reclosable opening that is substantially the same size as the opening in the outer box. This allows complete access to the bag opening to facilitate the initial opening, as well as the subsequent reclosing and opening of the bag. The bag opens wide and there is no interference from box flaps as product is poured from the container. These and other features and advantages will be in part apparent, and in part pointed out hereinafter.

BRIEF DESCRIPTION OF THE DRAWINGS

Corresponding reference numerals indicate corresponding parts throughout the several views of the drawings.

DETAILED DESCRIPTION OF THE INVENTION

Figure 1:
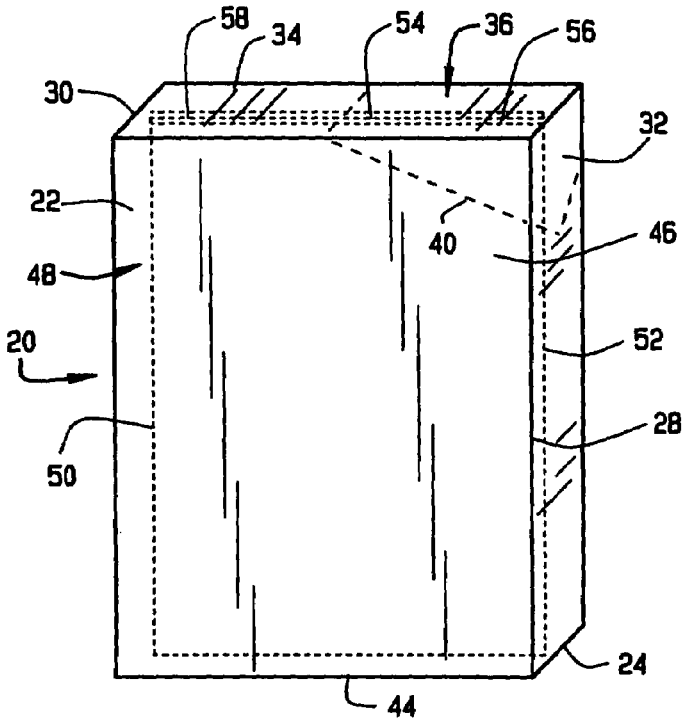
FIG. 1 is a perspective view of a package constructed according to the principles of this invention.

A package for cereal or other dry flowable food product constructed according to the principles of this invention is indicated generally as 20 in the Figures. The package 20 comprises a generally rectangular prismatic paperboard box 22, having a rectangular bottom panel 24, opposed rectangular front and back panels 26 and 28, opposed rectangular left and right side panels 30 and 32, and a rectangular top panel 34. The box 22 is preferably a twenty point clay coated paperboard (sometimes also referred to as newsboard or chip board). Of course the box 22 could be made of any other suitable material. The front and back panels 26 and 28 are wider than the side panels 30 and 32. The box 22 can be formed from a blank comprising a single sheet of paperboard. All of the surfaces can be imprinted with decoration, information, and/or advertising. The top panel 24 is preferably formed by conventional overlapping reclosable flaps (referred to in the industry as economy flaps), which can be used to open the top of the box 22, if desired. The box 22 of package 20 preferably can be made, assembled, and filled using existing conventional box equipment.

Figure 2:
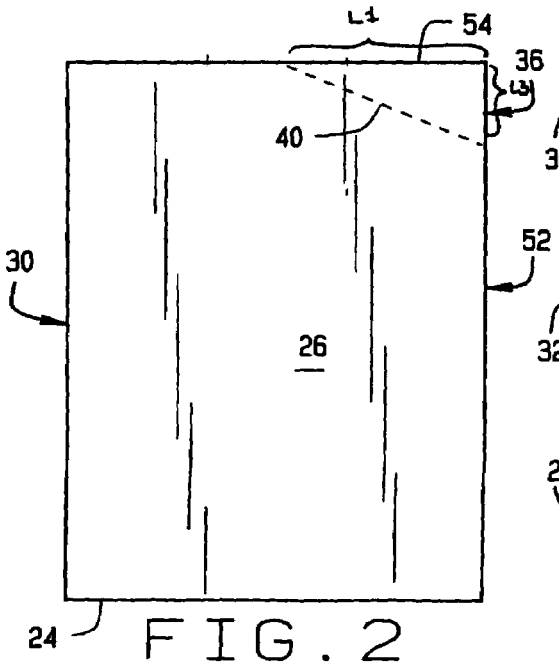
FIG. 2 is a front elevation view of the package.
Figure 3:
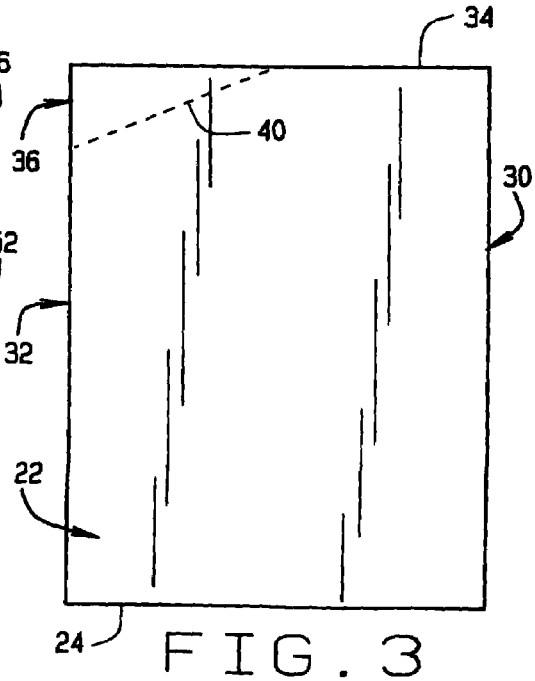
FIG. 3 is an rear elevation view of the package.
Figure 4:
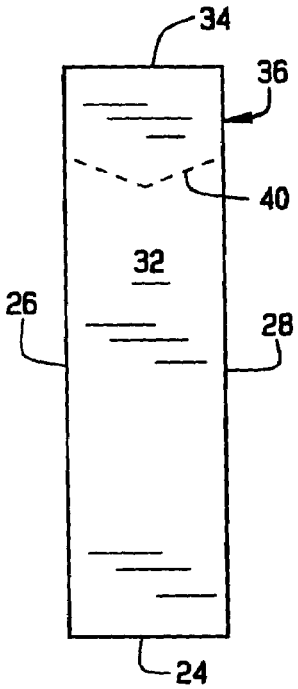
FIG. 4 is a right side elevation view of the package.

Some means for making an opening in the box 22 is provided. In this preferred embodiment a portion 36 of the box 22, including at least a part of the top panel 34, and preferably at least a part of the top panel 34, part of the front and back panels 26 and 28, and part of the right side panel 32, can be removed to make an opening 38 of length L1. Although the opening could extend the entire width of the top panel 34, the length L1 is less than the entire width of the top panel 34. In this preferred embodiment, a line of perforations 40 defines the removable portion 36. As shown in the Figures, the line of perforations 40 extends transversely across the top panel 34 (FIG. 5), diagonally downwardly across the front and back panels 26 and 28 (FIGS. 2 and 3), toward the right side panel 32. The line of perforations 40 forms a V-shape on the right side panel 32, as shown in FIG. 4. Of course, some means of separating the removable portion, instead of, or in addition to perforations, can be provided, such as a tear strip or pull string.

Figure 5:
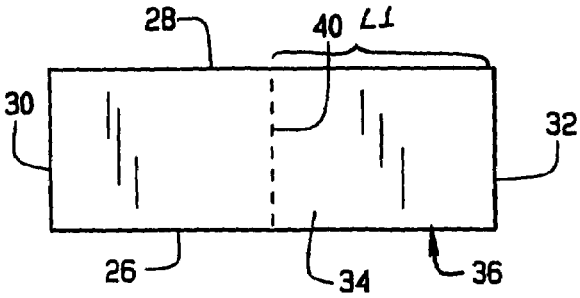
FIG. 5 is a top plan view of the package.
Figure 6:
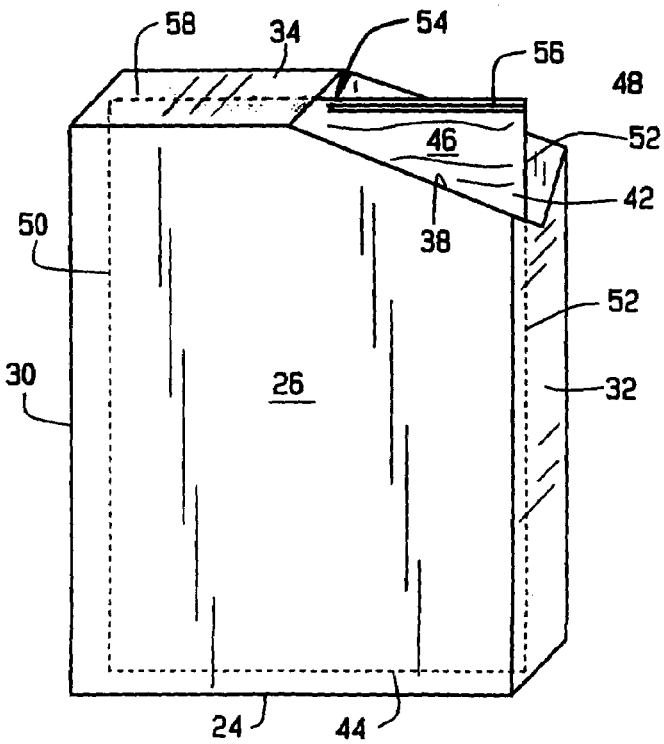
FIG. 6 is a perspective view of the package after opening.

The opening 38 in the box 22 could be formed by a partially removable portion 36, which is partially removed to form the opening but which remains partially attached to the box. For example, instead of a line of perforations extending transversely across the top panel 34 as shown in FIG. 5, a fold line, which may be scored, can be provided so that the removable portion 36 remains hingedly attached to the top panel, forming a flap.

The package 20 also includes a bag 42, inside the box 22. The bag 42 has a bottom 44, opposed front and back 46 and 48, opposed sides 50 and 52 extending between the front and back, and a top 54. In this preferred embodiment the bag 42 is made from a longitudinally seamed tube of acceptable liner material, such as high density polyethylene (HDPE), with a transversely extending bottom seam. For example the bag 42 could be made of a coextruded HDPE film between about 1.8 and about 3 mils thick, such as is available from Pechiney Plastic Packaging, 8770 West Bryn Mawr Ave., Chicago, Ill. 60631, or other suitable material may be used. The bag 42 is preferably formed by conventional vertical form/fill/seal (VFFS) equipment. For example, such equipment can be obtained from Triangle Package Machinery Company, 6655 West Diversey Avenue, Chicago Ill. 60707-2293, or from Robert Bosch Corporation, Packaging Technology Division, 9890 Red Arrow Highway, Bridgman, Mich. 49106. This equipment is readily adaptable to attach zipper closures to the bags as they are formed.

At the top 54 of the bag 42 is a reclosable portion 56. Although the recloseable portion could extend across the entire width of the top 54, in this preferred embodiment, the recloseable portion 56 extends from one side (e.g., side 52) only partly across the top, and a top seam 58 forming a closed portion extending from the end of the reclosable portion 56 to the other side (e.g., side 50) of the bag. The bag 42 is sized to fit relatively snugly inside the box 22. The length L2 of the reclosable portion 56 preferably corresponds to the length of the removable portion 46 and thus the length L1 of the opening 38 in the top. In general L2≦L1. Thus substantially the entire length of the reclosable portion 56 is accessible through the opening 38 so that the bag 42 can readily be opened and closed. The reclosable portion can be "zipper" formed by mating ridges formed in opposing edges of the bag wall. Preferably, however, the zipper closure is provided on a tape that is secured to the walls of the bag. Examples of suitable closures are the TopZip closure available from ZIP-PAK, a division of ITW, 1800 Sycamore Road, Manteno, Ill. 60950.

Figure 7A:
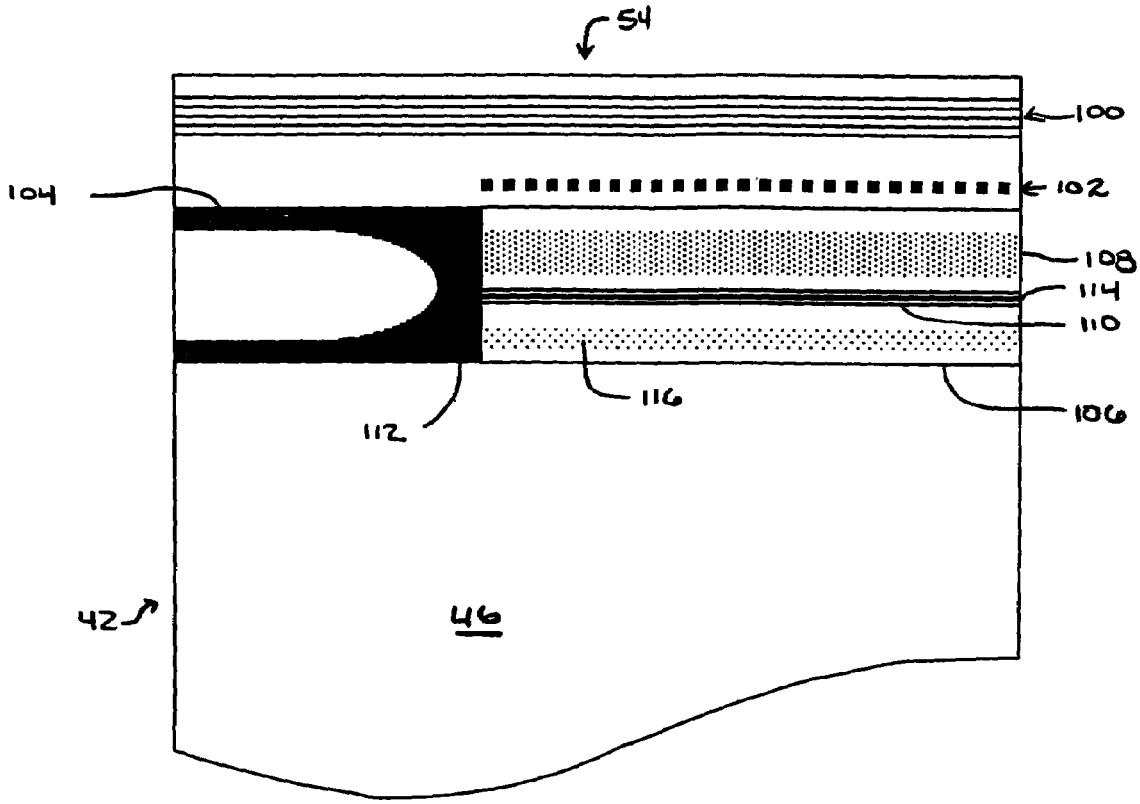
FIG. 7*a* is a schematic view of one possible sealing arrangement for the bags used in the package of this invention.
Figure 7B:
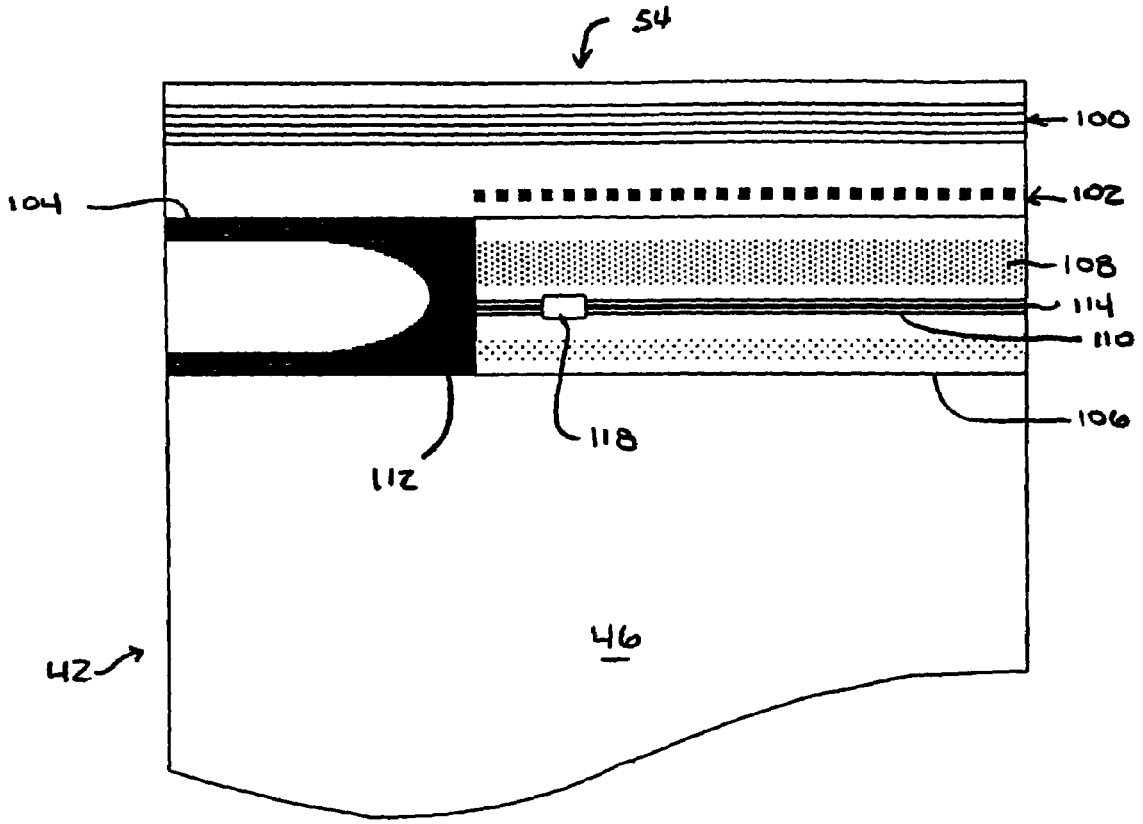
FIG. 7*b* is a schematic view of another possible sealing arrangement for the bags used in the package of this invention.
Figure 8:
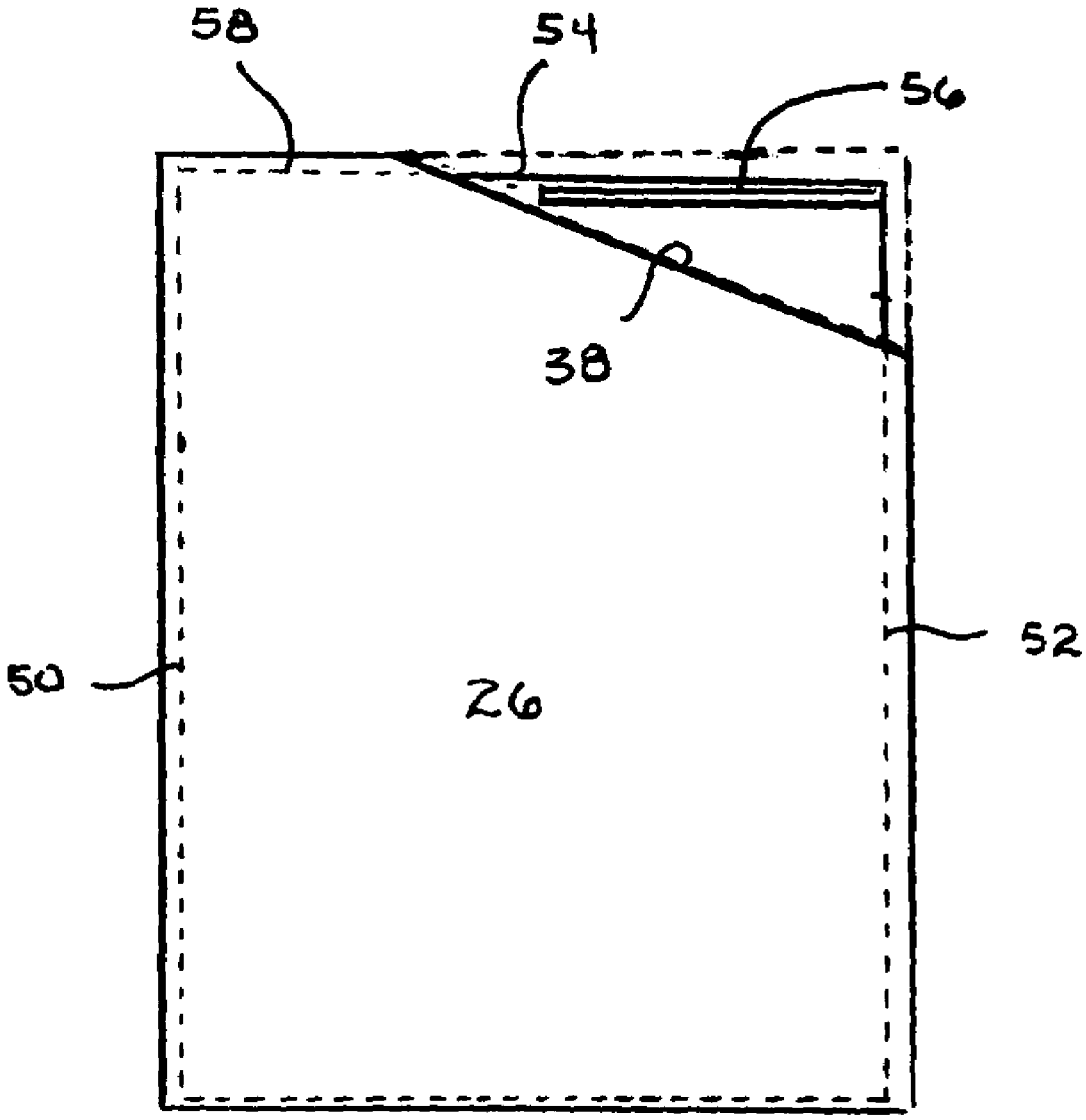
FIG. 8 is a front elevation view of an alternate construction of the package shown in FIGS. 1–6, with a larger opening
Figure 9:
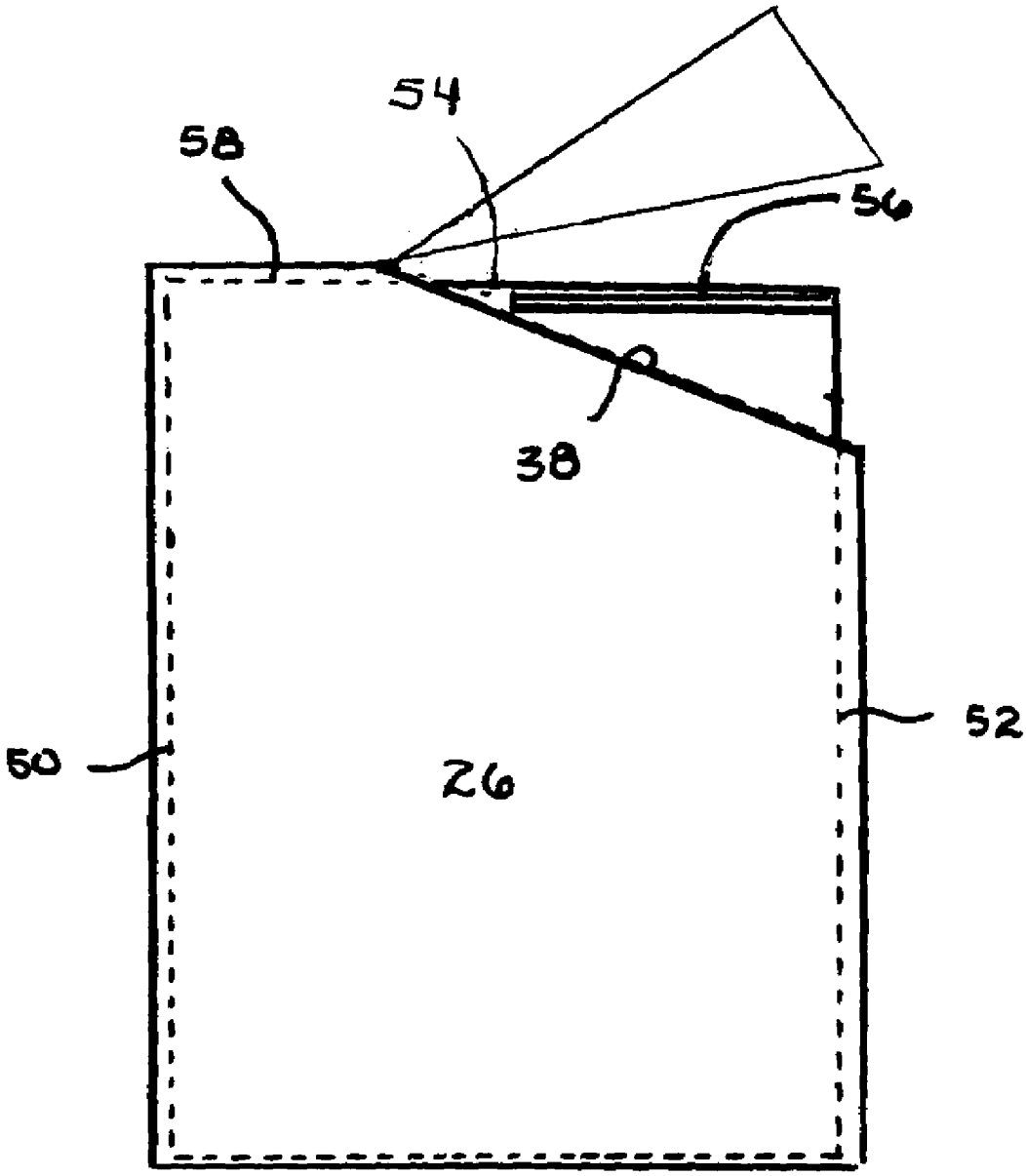
FIG. 9 is a front elevation view of an alternate construction of a package constructed in accordance with this invention, showing a hinged flap.

A possible sealing arrangement for the bag 42 is shown in FIGS. 7*a* and 7*b*. As shown in FIGS. 7 and 7*b*, the top of 54 the bag 42 has a seal 100 formed by bonding, fusing or heat sealing and crimping the front and back 46 and 48 together. A line of perforations 102 extends transversely at least partly across the bag 42. The line of perforations 102 allows the top portion of the bag 42 above the recloseable portion 56 to be removed by tearing. The line of perforations 102 may extend entirely across the bag, but it is sufficient that it extend partway across the bag, the material tearing at the end of the line of perforations so that the piece above the recloseable portion 56 can be removed. Below the line of perforations 102, the top seam 58 is formed by a plurality of lines 104 formed by heating and crimping. The recloseable portion 56 is formed on mating flanges 106 secured to the front and back 46 and 48 of the bag. An easy open seal 108 is created between the flanges 106 at the time of manufacture. The seal 108 helps to hold the flanges 106 together during manufacture of the bag, and remains intact through the manufacture process, and thereafter until the top is removed, and once the top is removed can be easily broken by the consumer. Below the seal 108 mating ridges 110 on the flanges 106 form a zipper closure. The ends of the zipper closure 112 and 114 are crimped together to facilitate engaging the mating ridges 110 of the zipper closure. A seal 116 between one of the flanges 106 and the front or back 46 or 48 of the bag 42 hold the flanges 106 in place during the manufacturing process.

The zipper closure shown in FIG. 7*a* is known as a press to close closure. As shown in FIG. 7*b*, the recloseable portion 56 could alternatively be a slide closure. As shown in FIG. 7*b*, a slider 118 can be incorporated into the zipper closure to facilitate the opening and closing of the bag 42.

Alternatively, the bag can be formed with some other zipper closure, a slide closure, a recloseably adhesive closure, or other closure that permits that bag to be repeatedly opened and closed compatible with the nature of the product. The bag 42 can be made, placed in the box and filled using existing conventional bag in box technology/machinery, with minor modification. The box 22 can be assembled around the bag, for example with conventional bag-in-box machinery, such as that available from R. A. Jones Company, Cincinnati Ohio 45201, or from Langen Packaging, Inc., 6154 Kestrel Road, Mississauga On L5T 1Z2, Canada.

The bag 42 can be made from printed material, which could then include conventional registration marks for operating the bag forming equipment, as is well known. However, the bag 42 is preferably made from unprinted material, which is less expensive, and any resulting slight variations in bag size can be accommodated within the box 22.

In the preferred embodiment the opening 38 that is formed in the top of the box 22 has a length L1 between about 3 and about 7 inches long, which for a typical cereal box (for example 8 inches wide, 2.6 inches thick, and 11.8 inches high) is between about 37.5% and about 87.5% of the width of the box. The length L2 of the reclosable portion 56 of the bag 42 is preferably similarly between about 3 and about 7 inches long, or for a typical cereal box is between about 37.5% and about 87.5% of the width of the box. The length L2 is preferably less than or equal to L1. At the right side of the carton, the length L3 of the removable portion carton is between about ½ inch and about 3 inches, so that a substantial portion of the top 54 of the bag protrudes through the opening 38 and is exposed in the vicinity of the reclosable portion 56, so that the bag 42 can be opened and closed. Thus, in a conventional cereal box, the depth of the removable portion is between about 4% and about 25% of the height of the box. The opening 38 is sized such that the portion of the top panel remaining after removal of the removable portion 36 is between about 1 and about 5 inches, or between about 12.5% and about 62.5% of the length of the top panel.

The size of the opening 38 in the box 42 and the size of the recloseable portion 56 of the bag 42, are selected depending upon the nature of the product, in particular the piece size and density. Thus, for example a dense granular cereal would need smaller recloseable portion 56 and opening 38 than a large flake cereal.

The package 20 comprises a box 22 and bag 42, however, rather than a conventional paperboard box as shown and described herein the box could be a paper can, which are increasingly popular or any other generally rigid container.

Operation

In use, the package 20 is opened by removing the removable portion 36 to remove a portion of the top panel 34, the side panel 32, and the front and back panels 26 and 28 to create an opening 38 in the box, and exposing a portion of the bag 42. The contents of the package 20 can be accessed by opening the reclosable portion 56 of the bag 42, substantially all of which is conveniently accessed through the opening 38 in the box 22. The contents can be poured from the package through the opening in the bag 42. The portion of the top panel 34 of the box 22 remaining engages the closed top portion 58 of the bag 42, retaining the bag in the box. This portion also helps to maintain the structural integrity of the box 22 as it is handled, and preferably forms a sufficient surface so that other packages can be stacked upon the package 20, even after it is opened. After the desired amount of the contents have been poured out, the reclosable portion 56 can be closed to keep the unused product fresh. The exposure of the top 54 and front and back 46 and 48 of the bag 42 facilitates operating the reclosable portion 56, and makes it easy to confirm that the bag is in fact closed. The fact that open portion of the bag 42 protrudes form the opening 38 means that the pouring is easy and accurate, and not obstructed by flaps on the box, as in a conventional package.

The bag 42 is easy to reseal, helping to keep the unused contents fresh. However, the package 20 still employs a box 22 which provides protection for the contents, and provides larger flat surfaces for providing product information and advertising. The box 22 is also makes the package 20 convenient to stand on a shelf.

What is claimed is:

1. A package for a flowable, dry food product, the package comprising:

an outer, generally rectangular prismatic cardboard box, comprising a top panel, a bottom panel, two opposed front and back panels, and opposed side panels extending between the front and back panels, a line of perforations extending across the top panel, diagonally downwardly and across each side to the end, and transversely across the end, so that the removable portion include a part of the top panel of the box, the sides of the box, and one end of the box, the removable portion when removed leaving an opening that includes a portion of the top panel less than the length of the front and back panels;

an inner bag inside the box, the top of the bag having a reclosable opening extending across only a portion of the top, generally corresponding in length to the length of the opening the reclosable portion comprising mating ridges formed on opposite sides of bag.

2. A package for a flowable, dry food product, the package comprising:

an outer, generally rectangular prismatic cardboard box, comprising a top panel, a bottom panel, two opposed front and back panels, and opposed side panels extending between the front and back panels, a line of perforations extending across the top panel, diagonally downwardly and across each side to the end, and transversely across the end, so that the removable portion include a part of the top panel of the box, the sides of the box, and one end of the box, the removable portion when removed leaving an opening that includes a portion of the top panel less than the length of the front and back panels;

an inner bag inside the box, the top of the bag having a reclosable opening extending across only a portion of the top, generally corresponding in length to the length of the opening the reclosable portion comprising a closure with a slide fastener.

* * * * *